United States Patent [19]

Stolfa et al.

[11] 3,992,284

[45] Nov. 16, 1976

[54] BLACK OIL CONVERSION PROCESS STARTUP AND SHUTDOWN METHODS

[75] Inventors: Frank Stolfa, Park Ridge; Michael D. Winfield, Bloomingdale, both of Ill.

[73] Assignee: UOP Inc., Des Plaines, Ill.

[22] Filed: Sept. 17, 1975

[21] Appl. No.: 614,291

[52] U.S. Cl. ..... 208/108; 208/146; 208/150; 208/213

[51] Int. Cl.[2] ..... C10G 13/00; B01J 27/04

[58] Field of Search ..... 208/108, 146, 150, 213

[56] References Cited

UNITED STATES PATENTS

| | | | |
|---|---|---|---|
| 3,375,189 | 3/1968 | Hamblin | 208/59 |
| 3,445,377 | 5/1969 | Steenburg | 208/93 |
| 3,501,396 | 3/1970 | Gatsis | 208/216 |
| 3,551,323 | 12/1970 | Hamblin | 208/58 |
| 3,586,620 | 6/1971 | Conner et al. | 208/111 |
| 3,642,613 | 2/1972 | Nagl | 208/213 |
| 3,748,261 | 7/1973 | Watkins | 208/58 |
| 3,795,607 | 3/1974 | Adams et al. | 208/210 |
| 3,847,799 | 11/1974 | Munro | 208/210 |
| 3,873,441 | 3/1975 | Jones | 208/166 |

*Primary Examiner*—Delbert E. Gantz
*Assistant Examiner*—G. E. Schmitkons
*Attorney, Agent, or Firm*—James R. Hoatson, Jr.; Robert W. Erickson; William H. Page, II

[57] ABSTRACT

Methods of starting up and shutting down reactors used in hydrocracking and hydrodesulfurization of black oils. The reactor is flushed with a heavy vacuum gas oil between the circulation of the black oil feed stream and the lighter hydrocarbon stream used during the low temperature portion of the operations.

11 Claims, No Drawings

BLACK OIL CONVERSION PROCESS STARTUP AND SHUTDOWN METHODS

FIELD OF THE INVENTION

The invention relates to methods of starting up and shutting down the reaction zone of a catalytic hydrocarbon conversion process such as found in Class 208. It is particularly directed to a method for use in processes for hydrocracking and hydrodesulfurization of black oils.

DESCRIPTION OF THE PRIOR ART

Heretofore, the reaction zones of a catalytic black oil hydroprocessing process have been started using a single hydrocarbon stream during the initial sulfiding and reaction zone warm-up steps which precede the contacting of the black oil with the catalyst. This stream has been a relatively light hydrocarbon, such as a light cycle oil, because of its lower viscosity at the temperature of the reaction zone during the initial period of a startup. The startup procedures described in U.S. Pat. Nos. 3,642,613 (Cl. 208-213) and 3,586,620 (Cl. 208-111) are representative of the single liquid startup method. Prior art shut-down methods have been essentially just the reverse of the startup procedures with the deletion of the unnecessary sulfiding and reduction steps. That is, the temperature of the reaction zone is reduced and the reaction zone is then flushed with a relatively light hydrocarbon. At a sufficiently low temperature, this hydrocarbon is then removed through the circulation of a gas stream.

BRIEF SUMMARY OF THE INVENTION

Catalyst deactivation during the startup and shutdown of a black oil desulfurization reactor is reduced by flushing the reactor with heavy vacuum gas oil either before or after the black oil circulates through the reactor as the situation requires. The basic steps in the subject startup method include circulating a relatively light hydrocarbon stream containing a sulfurous material and hydrogen through the reaction zone and effecting the sulfiding of the catalyst at a temperature with the range of about 200° F. to about 475° F., circulating a heavy vacuum gas oil through the reaction zone and affecting a flushing of the reaction zone, and raising the temperature of the reaction zone to within the range of from about 550° F. to about 650° F. and then introducing a feed stream comprising a black oil. During a shutdown operation, the method comprises the step of flushing the black oil from the reaction zone with a heavy vacuum gas oil.

DETAILED DESCRIPTION

There have been developed several processes for the catalytic hydrodesulfurization of that grouping of petroleum materials commonly referred to as black oils. Exemplary processes, catalysts and operating procedures are described in U.S. Pat. No. 3,373,441 (Cl. 208–166); 3,847,799 (Cl. 208–210); 3,795,607; 3,748,261; 3,445,377 (Cl. 208–93); 3,551,323 (Cl. 208–58); 3,501,396 (Cl. 208–216) and 3,375,189 (Cl. 208–59). Those skilled in the petroleum refining arts are familiar with these and other processes which are being used commercially. An extensive review of the current state of the art of hydrocracking is contained in the article at page 74 of *Industrial and Engineering Chemistry*, Prod. Res. Dev., Vol. 14, No. 2, 1975.

Those black oil hydroprocessing operations to which the subject invention is directed may be characterized as including the circulation of a black oil, as defined herein, and hydrogen through a densely packed bed of catalyst operated with a maximum temperature in the range of from about 650° F. to about 850° F. and at a pressure of from about 1,000 psig. to 5,000 psig. Ebulated, slurry and fluidized systems are not within this characterization.

Each of the several commerical processes must initially be started in a manner which gives optimum performance of the catalyst. Furthermore, it is occasionally necessary to shut down the reaction zone of the process before the deactivation of the catalyst requires it to be shut down. This could be due for instance to mechanical failures, the planned shut-down of upstream or downstream units or the scheduled shutdown of the black oil process itself. It is desirable to be able to restart the reaction zone and achieve the same performance as before the forced shut-down. Unfortunately, this has not been achieved and there has been experienced a decrease in catalyst activity during the shut-down and restartup sequence. This is most noticeable in the catalysts' desulfurization activity and may approach a 15–20% decrease in this activity. It is an objective of this invention to provide methods of starting, shutting down and restarting the reaction zones of hydroprocessing processes which reduce the amount of catalyst deactivation which is experienced.

A second objectionable consequence of the shutdown of a black oil hydroprocessing reaction zone is the increased pressure drop through the reaction zone which results and is observable when the reaction zone is once again brought on-stream. It is therefore a further objective of the invention to provide a method of shutting down and restarting reaction zones containing active catalyst which alleviates this pressure drop increase.

Commerical operation has indicated these objectives are achieved by the use of a heavy vacuum gas oil as a flush material circulated through the reaction zone between the lighter oil normally used in these procedures and the black oil. During a startup, the flushing operation is performed before the black oil is cut in. During a shutdown, the flushing operation is performed before the lighter oil is cut in. The limited commercial data available indicates an orderly shut-down and startup by the subject method causes greatly decreased activity losses of from about 0 to 5%.

Although it is impossible to actually monitor what occurs at the catalyst surface in the reaction zone, it is believed that the methods of the invention achieve their beneficial results by the prevention or limitation of the precipitation of asphaltenes on the catalyst. Asphaltenes, also referred to as heptane insolubles, are known to cause catalyst deactivation. At reaction temperatures, the asphaltenes are convented to coke and block the active sites of the catalyst. In the prior art methods a lighter hydrocarbon stream, as compared to a heavy vacuum gas oil, is circulated through the reaction zone up to the time when the black oil is cut in or immediately after it is cut out. This hydrocarbon stream is chosen from those readily available to the refiner and is normally a light distillate such as a diesel oil or light cycle oil. The use of such a material is necessary at the lower temperatures where the viscosity of the black oil is above a limiting value of about 5 centistokes, the point at which the viscosity of the oil would cause sufficient pressure drop to make gas circulation through the reactor unfeasible.

It is theorized that the lighter hydrocarbon stream and the black oil interact in a manner similar to a solvent deasphalting process to cause the precipitation of the asphaltenes. UOP Analytical Procedure No. 174 for predicting the storage stability of residual fuel oils indicates that a blend of 10 L.V.% of a black oil component and 90 L.V.% of a 500°–700° F. diesel fuel was unstable. This mixture gives a No. 3 reading in the Gulf Spot Test. In contrast, a blend of 10 L.V.% of the black oil component and 90 L.V.% of a 700°–1015° F. vacuum gas oil was stable and there was no precipitation. In these tests, the black oil component was material removed from the hot flash zone of a black oil conversion process. This material is representative of the liquid found within the reaction zone and differs only by the absence of hydrogen and any light hydrocarbons which have been stripped away. The inventive concept therefore involves at least a partial flushing of the reaction zone with a heavy vacuum gas oil between the circulation of the black oil and the lighter hydrocarbon. This flushing operation is preferably carried on for a period of time sufficient to effect at least two volume changes of the liquid inventory of the reactor. The flushing operation is the same during a startup, restart or shut-down of the reaction zone.

The various petroleum fractions referred to herein may be defined in general terms by their boiling point ranges. The actual ranges will however vary in different situations depending on such factors as crude oil compositions, the capability of the fractionation columns, the nature of downstream units and the desired products. It is intended to adopt the customary definitions of those skilled in the art and classify these streams by the location they are withdrawn from the respective fractionation unit. However, to provide a definition which allows comparisons or the classification of different blends, the term atmospheric gas oil will be used to refer to a petroleum fraction having a boiling point range of from about 400° F. to about 650° F. as determined by the appropriate ASTM distillation method. Likewise, a heavy vacuum gas oil will have a boiling point range of from about 650° F. to about 1050° F. and may be further characterized in that it contains less than about 0.3 wt.% asphaltenes. Preferably the heavy vacuum gas oil will contain less than 0.1 wt.% asphaltenes. The composition of light cycle oils and light distillates is more loosely defined but these very similar materials will have boiling point ranges falling between about 400° F. to about 680° F. A light cycle oil differs from an atmospheric gas oil mainly in that it originates at the main column of a fluidized catalytic cracking unit while the atmospheric gas oil is removed from a crude column. As used herein, the term black oil is intended to refer to a petroleum fraction containing more than about 1.0 wt.% asphaltenes and having a boiling point range above 650° F. Two of the most common refinery streams which are considered black oils are reduced crudes, normally the portion of a crude oil boiling above about 650° F. and containing from 1 to 15 wt.% asphaltenes, and vacuum column bottoms, which normally boil above about 975° F. and contain from 1 to 20 wt.% asphaltenes.

The startup of a desulfurization reactor will often include the steps of purging, prewetting, reduction and sulfiding the catalyst. These are standard commercial practices during which the pressure within the reaction zone is raised and the temperature increased to a level which effects the sulfiding. Preferably, these initial steps are performed in accordance with the teachings of U.S. Pat. No. 3,642,613 and include the circulation of a hydrocarbon stream containing a sulfurous material such as hydrogen sulfide, alkyl mercaptans or alkyl sulfides. The hydrocarbon stream may be any suitable relatively low viscosity stream, such as a light cycle oil or atmospheric gas oil. As an alternative, the sulfiding may be performed using a circulating gaseous stream containing hydrogen sulfide or another volatile sulfurous compound. The sulfiding operation will preferably be conducted at a temperature of from about 200° F. to about 475° F. The temperature of the reaction zone is then raised to about 475° F. or above to facilitate the circulation of the heavy vacuum gas oil. While this material is passing through the reaction zone, the temperature of the reaction zone is further increased to within the range of from about 550° F. to 650° F. These two steps are normally performed simultaneously to reduce the time required during startup. At these elevated temperatures the black oil may be introduced. The reaction zone is then brought up to the required temperature for the desired degree of desulfurization. This will normally be greater than about 650° F. The maximum temperature which would be employed in the reaction zone should be under about 850° F. Unless otherwise specified, those temperatures recited herein refer to the maximum temperature measured within the reaction zone.

In accordance with the above description, the preferred embodiment of the startup method of the invention may be characterized as comprising the steps of circulating a stream comprising high purity hydrogen through a reaction zone containing a bed of catalyst while raising the pressure in the reaction zone to within the range of from about 1000 psig. to about 5,000 psig. and increasing the temperature in the reaction zone to within the range of about 200° F. to about 475° F.; sulfiding bed of the catalyst by circulating a sulfurous material through the reaction zone; circulating an atmospheric gas oil through the reaction zone and raising the temperature in the reaction zone to above about 475° F.; circulating a heavy vacuum gas oil through the reaction zone for a sufficient time to effect at least two volume changes of the liquid within the reaction zone and raising the temperature in the reaction zone to within the range of about 550° F. to about 650° F.; and introducing a black oil feed stream and raising the temperature within the reaction zone to within the range of from about 650° F. to about 850° F.

As the proposed theory for the beneficial result of the invention does not depend on the action of the catalyst within the reaction zone, the invention may be applied to any method of catalytically hydroprocessing a black oil feed stock regardless of catalyst composition if the process fits the previously set out characterization. It may be applied to both fixed-bed and moving-bed reaction zones and to all black oil processes including those directed specifically to hydrodesulfurization, demetallization or hydrocracking. As used herein the term reaction zone is intended to include a single reactor containing one or more beds of catalyst and a plurality of reactors operated in series or parallel. As previously mentioned, the inventive concept is not limited to the startup of a unit containing fresh or newly regenerated catalyst and may be applied to the shutdown and restarting of units containing used but still commercially acceptable catalyst. The initial steps such as sulfiding are normally not necessary and the restart procedure basically comprises the warming of the reaction zone and the sequential circulation of the various petroleum fractions at the appropirate temperatures. These temperatures are the same ranges as used in the startup procedure set out above. They are of course gone through in the opposite order during a shut-down.

The preferred embodiment of the subject shutdown method may be described as comprising the steps of lowering the temperature of the reaction zone to within the range of about 550° F. to about 650° F. while circulating the feed stream, circulating a heavy vacuum gas oil through the reaction zone for a sufficient time to effect at least two volume changes of the liquid within the reaction zone and lowering the temperature of the reaction zone to within the range of about 400° F. to about 550° F., and circulating an atmospheric gas oil through the reaction zone and further lowering the temperature of reaction zone.

We claim as our invention

1. In the methods of starting up a catalytic black oil hydroprocessing reaction zone wherein there is circulated a light distillate as the temperature within the reaction zone is gradually increased and the black oil is then charged to the reactor, the improvement which comprises flushing the inventory of light distillate from the reactor by circulating a heavy vacuum gas oil before the black oil is charged to the reactor.

2. A startup method for a black oil hydroprocessing process which comprises the steps of:

a. circulating a hydrocarbon stream containing a sulfurous material and hydrogen through a bed of catalyst contained with a reaction zone at a temperature in the range of about 200° F. to about 475° F. and effecting the sulfiding of the bed of catalyst;

b. raising the temperature of the reaction zone above about 475° F. and then circulating a heavy vacuum gas oil through the reaction zone and effecting a flushing of the hydrocarbon stream from the reaction zone; and, c. raising the temperature of the reaction zone to within the range of from about 550° F. to about 650° F. and then introducing a feed stream comprising a black oil.

3. The method of claim 2 further characterized in that the hydroprocessing process is a hydrocracking process.

4. A startup method for a black oil hydroprocessing process which comprises the steps of:

a. circulating a stream comprising hydrogen through a reaction zone containing a bed of catalyst while raising the pressure in the reaction zone to within the range of from about 1000 psig. to about 5,000 psig. and increasing the temperature in the reaction zone to within the range of about 200° F. to about 475° F.;

b. sulfiding the bed of catalyst by circulating a sulfurous material through the reaction zone;

c. circulating an atmospheric gas oil through the reaction zone and raising the temperature in the reaction zone to above about 475° F.;

d. circulating a heavy vacuum gas oil through the reaction zone for a sufficient time to effect at least two volume changes of the liquid within the reaction zone and raising the temperature in the reaction zone to within the range of about 550° F. to about 650° F., and, e. introducing a black oil feed stream and raising the temperature within the reaction zone to within the range of from about 650° F. to about 850° F.

5. A method for restarting a reaction zone used for the desulfurization of a feed stream comprising a black oil which has been temporarily shut down and which contains a bed of sulfided catalyst comprising the steps of:

a. raising the pressure of the reaction zone and circulating a light distillate while the temperature of the reaction zone is raised to within the range of from about 200° F. to about 475° F.;

b. circulating a heavy vacuum gas oil through the reaction zone and raising the temperature of the reaction zone to within the range of from about 550° F. to about 650° F.; and, c. introducing the black oil feed stream and increasing the temperature of the reaction zone to within the range of about 650° F. to about 850° F.

6. The method of claim 5 further characterized in that the heavy vacuum gas oil is circulated through the reaction zone for a sufficient time to effect at least two volume changes of the liquid within the reaction zone.

7. A method for restarting a reaction zone used for the desulfurization of a feed stream comprising a black oil which has been temporarily shut down and which contains a bed of sulfided catalyst comprising the steps of:

a. raising the pressure of the reaction zone and circulating an atmospheric gas oil while the temperature of the reaction zone is raised to within the range of from about 200° F. to about 475° F.;

b. circulating a heavy vacuum gas oil through the reaction zone and raising the temperature of the reaction zone to within the range of from about 550° F. to about 650° F.; and, c. introducing the black oil feed stream and increasing the temperature of the reaction zone to within the range of about 650° F. to about 850° F.

8. A method of shutting down a reaction zone used for the catalytic hydroprocessing of a feed stream comprising a black oil which comprises the steps of:

a. lowering the temperature of the reaction zone to within the range of about 550° F. to about 650° F. while circulating the feed stream;

b. circulating a heavy vacuum gas oil through the reaction zone for a sufficient time to effect at least two volume changes of the liquid within the reaction zone and lowering the temperature of the reaction zone to within the range of about 400° F. to about 550° F.; and, c. circulating an atmospheric gas oil through the reaction zone and further lowering the temperature of the reaction zone.

9. The method of claim 8 further characterized in that the hydroprocessing process is a hydrocracking process.

10. The method of claim 8 further characterized in that the hydroprocessing process is a hydrodesulfurization process.

11. A method of shutting down a reaction zone used for the catalytic hydroprocessing of a feed stream comprising a black oil which comprises the steps of:

a. lowering the temperature of the reaction zone to within the range of about 550° F. to about 650° F. while circulating the feed stream;

b. circulating a heavy vacuum gas oil through the reaction for a sufficient time to effect at least two volume changes of the liquid within the reaction zone and lowering the temperature of the reaction zone to within the range of about 400° F. to about 550° F.; and, c. circulating a light distillate through the reaction zone and further lowering the temperature of reaction zone.

* * * * *